US005255320A

United States Patent [19]

Ribíc

[11] Patent Number: 5,255,320

[45] Date of Patent: Oct. 19, 1993

[54] HEARING AID

[75] Inventor: Zlatan Ribíc, Vienna, Austria

[73] Assignee: Viennatone GmbH, Vienna, Austria

[21] Appl. No.: 644,911

[22] Filed: Jan. 23, 1991

[30] Foreign Application Priority Data

Feb. 2, 1990 [AT] Austria ..... A228/90

[51] Int. Cl.[5] ..... H04R 25/00

[52] U.S. Cl. ..... 381/68.4; 381/68.2; 381/108

[58] Field of Search ..... 381/68.4, 68.2, 68, 381/104, 107, 108, 67

[56] References Cited

U.S. PATENT DOCUMENTS 3,571,529 3/1971 Gharib ..... 381/68
3,818,149 6/1974 Stearns et al. ..... 381/68.2
4,790,018 12/1988 Preves et al. ..... 381/68.4
4,792,977 12/1988 Anderson ..... 381/68.4

FOREIGN PATENT DOCUMENTS 0446195 9/1991 European Pat. Off. ..... 381/68
0295711 12/1986 Japan ..... 381/107

OTHER PUBLICATIONS

"Hearing well in noise with VASM", Viennatone automatic signal management, Apr. 24, 1992.

*Primary Examiner*—Jin F. Ng
*Assistant Examiner*—Huyen D. Le
*Attorney, Agent, or Firm*—Kurt Kelman

[57] ABSTRACT

A single-channel circuit for a hearing aid for persons with an impaired hearing faculty has a pre-amplifier and an output amplifier, a microphone and an earphone, as well as a full-wave rectifier circuit for producing a control voltage for a voltage-dependent attenuator connected to the pre-amplifier. In order to allow a favorable speech audibility characteristic over the entire amplification range, a voltage-controlled filter is provided for a single-dependent change in the frequency response. The control input of the filter is connected to the rectifier circuit. The filter is connected to the rectifier circuit via a time function element.

9 Claims, 3 Drawing Sheets

HEARING AID

BACKGROUND OF THE INVENTION

1. Field of the Invention

The present invention relates to a hearing aid. More particularly, the invention relates to a single-channel circuit for a hearing aid for persons with an impaired hearing faculty. The circuit of the invention has a pre-amplifier and an output amplifier, a microphone and an earphone, as well as a rectifier circuit for producing a control voltage for a voltage dependent amplifier or attenuator which is connected to said pre-amplifier.

2. Prior Art

Such circuits result in an amplification which depends on the signal level of the acoustic signals to be amplified, thus avoiding overamplification and keeping the output signal of the hearing aid within a specific volume level. This prevents strong fluctuations in the volume. Additionally, the frequency response in such circuits essentially remains the same over the whole amplification range which impairs the audibility of speech in the presence of louder background noises.

A better adjustment of the frequency response of the amplification to the user's loss in hearing is achieved in hearing aids by providing two or multiple-channel circuits which mostly comprise a volume compression in the bass channel and a linear amplification in the treble channel, whereby both signals are summed before the output amplifier. In these systems the compression is achieved by a voltage-controlled amplifier.

A disadvantage of the known circuits is their costliness. Furthermore a casing housing such a circuit must be sufficiently large which is a considerable disadvantage for hearing aids.

BRIEF SUMMARY OF THE INVENTION

It is the object of the present invention to eliminate such disadvantages and to provide a circuit of the above-mentioned kind which allows, concerning the audibility of speech, favorable characteristics over the whole amplification range.

In accordance with the invention, this is achieved by a voltage-controlled filter for a signal-dependent change in the frequency response. The control input of the filter is connected to the rectifier circuit via a time function element and the rectifier circuit is preferably a full-wave rectifier circuit.

These measures allow the frequency response to be changed over the amplification range depending on the level of the picked-up acoustic signal. Thus, when the input signals are loud, the amplification in the range of the lower frequencies is lowered and when the input signals are low, reproduction is on a wide-band level.

The use of a full-wave rectifier circuit has the advantage that even when there are strongly unsymmetrical signals, such as voice signals, a control voltage is produced which is, from a value point of view, precisely in accordance with the audio signal.

Another feature of the invention is that the voltage-controlled attenuator is connected to the rectifier circuit via a separate time function element. The connection of the voltage-controlled amplifier and the voltage-controlled filter via separate time function elements provides the advantage that their characteristics may be adjusted independently from one another to the respective requirements.

In the hearing aid the smallest possible battery is desired for the power supply in order to guarantee a compact arrangement, thus requiring only very small voltages to be used. It is therefore necessary to provide a rectifier circuit which operates with very small voltages.

In accordance with the invention, the rectifier circuit includes two transistors whose main current paths are connected in series with resistors and the series connections are connected in parallel with each other. The base of one transistor is thus connected to the collector of the second transistor via a diode. The bases of both transistors are connected to each other via at least one resistor and the collector of the one transistor connected to the diode is connected via another resistor to the base of said one transistor. The control voltage may be derived from the collector of the transistor having its base connected to the diode.

A rectifier bridge could also be used, but this would result, due to the low voltages, in considerable problems because the diodes would require relatively high starting voltages. In the rectifier circuit of the invention, the starting voltage of the diode is practically without effect, due to amplification through the first transistor.

The voltage-controlled filter may comprise a three- or four-pole or terminal network, to which a transistor is connected in a bootstrap circuit. A control transistor is thereby provided whose main current path is connected in series with the transistor in the bootstrap circuit and whose base is connected to the rectifier circuit providing the control voltage. This results in a very simply arrangement of a voltage-controlled filter, thus, influencing the frequency response of the hearing aid depending on the level of the picked-up audio signal.

Another feature of the invention is that the voltage-controlled filter comprises two different three terminal networks, preferably four terminal networks to which transistors are connected in a bootstrap circuit. At least one of the bases of the transistors is connected to the rectifier circuit via a time function element and, optionally, the pre-amplifier is connected to the inputs of the three- or four-terminal networks via the adjustable terminal of a potentiometer. This allows changing the frequency response of the amplification depending on the level of the registered sound signal and thus achieving a considerable improvements in the audibility of speech.

In a preferred embodiment of the invention, the voltage-controlled filter is controlled by a potentiometer circuit to which a signal voltage received from the pre-amplifier and the control voltage from the rectifier circuit are applied. The signal voltage from the pre-amplifier thus attenuate the effect of the filter when there are high signal levels.

Under extreme conditions, this permits a favorable influence on the operating characteristics of the hearing aid with respect to better audibility of speech.

BRIEF DESCRIPTION OF THE DRAWINGS

The invention is now explained in greater detail with reference to the enclosed drawings, in which.

DETAILED DESCRIPTION OF PREFERRED EMBODIMENTS

Figure 1:
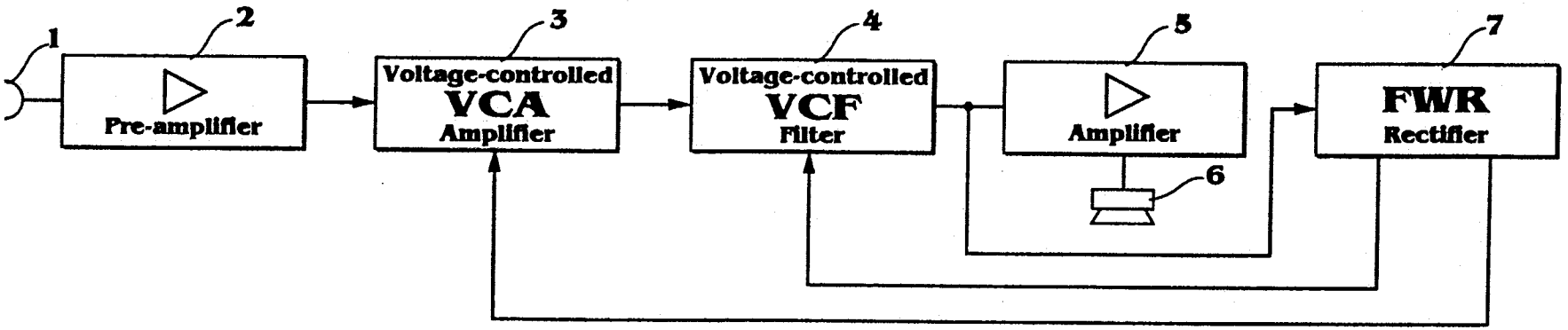
FIG. 1 is a block diagram of an embodiment of the hearing aid of the invention.

The hearing aid of the invention is shown in FIG. 1. As is known, a pre-amplifier 2 is connected to a microphone 1. The output of the pre-amplifier is connected to a voltage-controlled amplifier 3 which may have an amplification factor less than 1 and therefore may act as an attenuator. A voltage-controlled filter 4 is connected to the voltage-controlled amplifier 3 for providing automatic control of the frequency response, whereby said amplifier may have a bipolar transistor, or, for example, an amplifier with a controlled operating point functioning as automatic volume control.

The frequency response is preferably arranged for automatic bass attenuation upon occurrence of louder signals, thus facilitating the understanding and the hearing of speech in a noisy environment.

The filter 4 is connected to an output amplifier 5, so the signal output of said filter reaches said amplifier. An earphone 6 is connected to the output amplifier 5. A rectifier circuit 7 is provided for rectifying a signal derived from between the voltage-controlled filter 4 and the output amplifier 5. The rectifier circuit 7 supplies a rectified signal as a control voltage to the voltage-controlled amplifier 3 and to the voltage-controlled filter 4. The place of installation of the volume control (not shown) determines whether the control is an input or output control.

The rectifier circuit 7 is a full-wave rectifier and is explained below in greater detail by reference to FIGS. 4 and 5.

Figure 2:
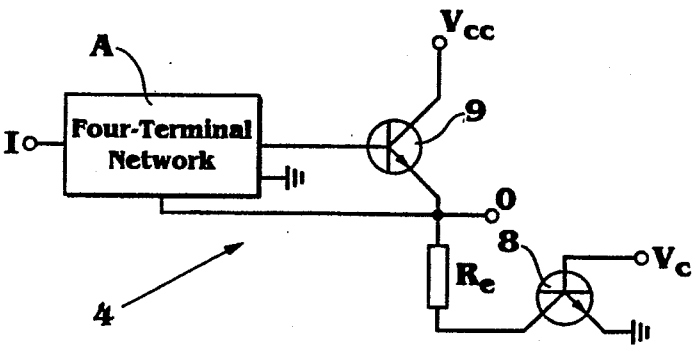
FIG. 2 is a part block diagram, part circuit diagram of an embodiment of the voltage-controlled filter of FIG. 1.

The voltage-controlled filter 4 may, for example, be connected in accordance with FIG. 2, wherein a four-terminal network A is provided which, for example, may be an R/C-filter. A transistor 9 is connected in a bootstrap circuit and has a collector connected to the supply voltage $V_{cc}$ and a base and emitter are connected to four-terminal network A. The four-terminal network is a high-pass, low-pass, band-pass filter, or band elimination filter.

In the embodiment of the voltage-controlled filter of FIG. 2, emitter resistor $R_e$ is connected in series with a control transistor 8 whose emitter is connected to ground and whose base is supplied with a control voltage $V_c$ taken from the rectifier circuit 7. If the control voltage $V_c$ has a high potential, the transistor 8 is fully conductive and acts upon the output signal of four-terminal network A like an emitter follower.

Figure 4:
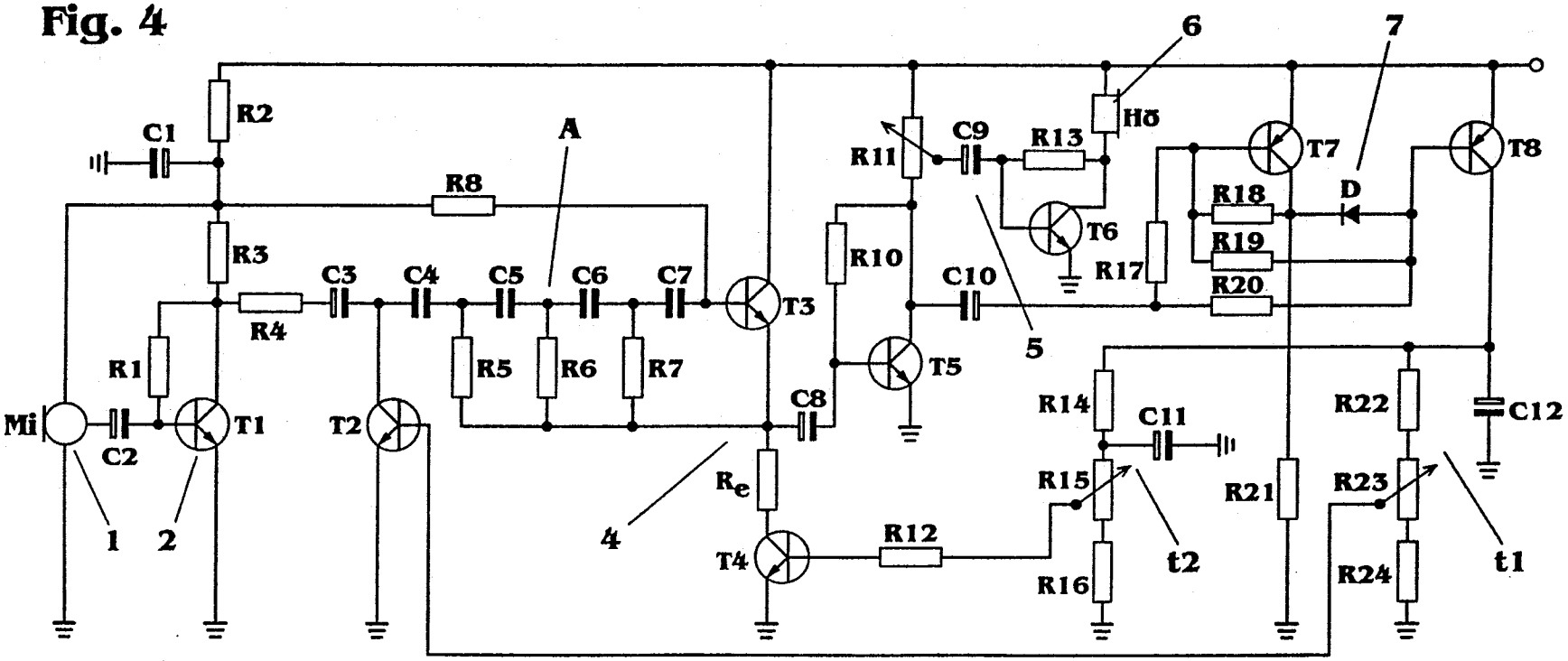
FIG. 4 is a circuit diagram of a first embodiment of the hearing aid of the invention.

If the control voltage $V_c$ is very low, transistor 8 blocks and the input signal of four-terminal network A moves directly and essentially unchanged to the output O, e.g., via capacitors C4, C8 and resistor R5, as shown in FIG. 4.

Figure 3:
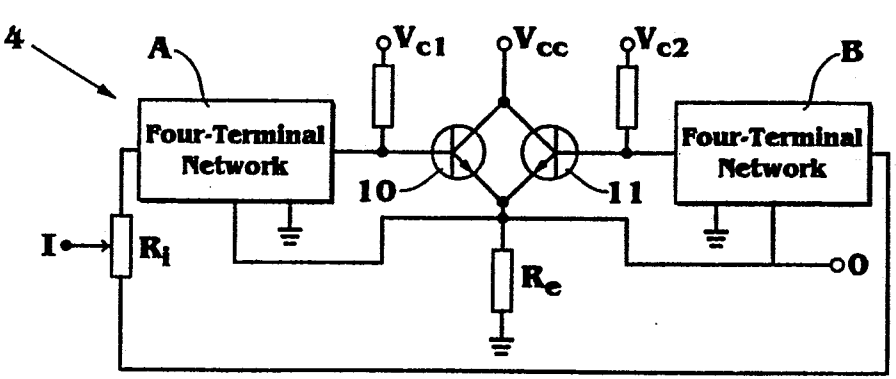
FIG. 3 is a part block diagram, part circuit diagram of another embodiment of the voltage-controlled filter of FIG. 1.

In the other embodiment of the voltage-controlled filter of FIG. 3, two four-terminal networks A and B are connected to transistors 10 and 11 connected in parallel. The transistors 10 and 11 have a common emitter resistor $R_e$. The two four-terminal networks A and B are conveniently high-pass or low-pass filters. Control voltages $V_{c1}$, $V_{c2}$ are connected via resistors to the outputs of four-pole networks A and B, respectively, or the bases of transistors 10, 11, respectively, said voltages being derived from rectifier circuit 7 and differing in levels. The control voltages may be tapped, for example, from a voltage divider circuit (not shown here) connected to rectifier circuit 7. In this embodiment of the voltage-controlled filter, input signal I may be divided via potentiometer $R_i$ to the two four-terminal networks A and B of the filter, thus allowing a fixed presetting.

If the two control voltages $V_{c1}$ and $V_{c2}$ are selected equivalently, the two four-terminal networks A and B are simultaneously in operation and a change in the common control voltage allows the termination of all intermediate functions.

FIG. 4 shows a first embodiment of the hearing aid of the invention. Transistor T1 functions here as pre-amplifier 2, the base of which is connected to microphone 1 via capacitor C2. Transistor T1 is connected in known manner to resistors R3 and R1.

The R/C circuit R2, C1 functions as a filter.

Transistor T2 in combination with resistor R4 and coupling capacitor C3 functions as voltage-controlled amplifier 3 for automatic amplification control. Capacitor C4 to C7 in combination with resistors R5 to R8, provided a four-terminal network of a higher order, which, in combination with transistor T3, emitter resistor $R_e$ and control transistor T4, functions as voltage-controlled filter 4. Transistors T3 and T4 of FIG. 4 are thereby similar to transistors 8 and 9 of FIG. 2.

If the control voltage derived from the rectifier circuit is low, the signal reaches amplification transistor T5 essentially unchanged via capacitor C4, resistor R5 and capacitor C8. Transistor T5 thereby functions as the output stage in known manner with resistor R11, capacitor C9, resistor R13 and transistor T6, to which earphone 6 is connected.

If, however, the control voltage applied to control transistor T4 is high, transistor T3 functions as an emitter follower and four-terminal network A forms a high-pass filter of the fourth order in a bootstrap circuit.

The signal for the rectifier circuit 7, consisting essentially of two transistors T7 and T8 and diode D, is derived from transistor T5 and reaches the base of transistor T7 of said rectifier circuit via capacitor C10 and resistor R17. In rectifier circuit 7, resistor R18 functions to adjust the operating point.

In the event of negative half-waves of the input signal, diode D blocks and transmission of the signal occurs directly via resistor R20. In the event of positive half-waves, amplification depends on the ratio between resistors R19 and R17. The symmetry in the full-wave rectification of the input signal is safeguarded by providing resistors R18 to R20 with sufficient resistances.

In the embodiment shown in FIG. 4, a decreasing control voltage occurs at the base of transistor T8 when the signal increases. If the terminals of diode D were reversed, it would also be possible to derive an increasing control voltage when the signal is rising.

Transistor T8 operates as a control voltage amplifier. The collector of transistor T8 is connected to capacitor C12 and functions as a time function element t1 in combination with resistors R22 to R24. The control voltage for transistor T2 is derived from resistor R23 which, as hereinbefore mentioned, functions as a voltage-controlled attenuator.

Furthermore, the rectified control voltage is supplied via resistor R14 to an additional time function element t2 consisting of capacitor C11 and resistors R15 and R16. The time constant of additional time function element t2 is larger than that of time function element t1, whereby control transistor T4 is connected to time function element t2.

This leads to the automatic amplification control being active for short pulses or signals only. the control is provided by transistor T2 driven via time function element t1 having the shorter time constant. The response time is determined by the internal resistance of transistor T8 and capacitor C12 and the decay time determined by capacitor C12 and the resistance derived form the parallel connection of resistor R14 with resistors R22 to R24.

If signals are of longer durations with large amplitudes, capacitor C11 is also loaded via resistor R14 and thus voltage-controlled filter 4 is activated. The decay time for voltage-controlled attenuator 3 and voltage-controlled filter 4 is determined by capacitor C11 and the combination of resistor R15 and R16 connected in parallel with resistors R14 and R22 to R24.

Figure 6:
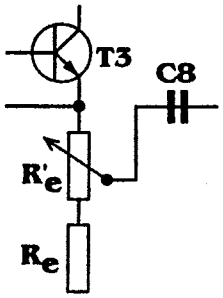
FIG. 6 is a circuit diagram of a first embodiment of a control circuit for controlling the voltage-controlled filter of FIG. 4.

FIG. 6 shows a first embodiment of a control circuit for supplying the control voltage to the voltage-controlled filter A slightly different from the embodiment of FIG. 4. The embodiment of FIG. 6 differs from that of FIG. 4 in that resistor $R_e$ is connected between transistor T4 and a potentiometer $R'_e$ whose other end terminal is connected to transistor T3. The adjustable terminal of the potentiometer $R'_e$ is connected to capacitor C8. The remainder of the circuit remains unchanged with regard to FIG. 4. Voltage-controlled filter A is therefore supplied with a signal voltage from pre-amplifier 2 and with a control voltage supplied by rectifier circuit 7. In this embodiment a high signal voltage attenuates the effect of filter A depending on the position of the potentiometer.

Figure 7:
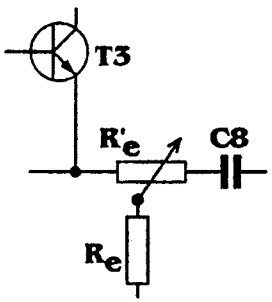
FIG. 7 is a circuit diagram of a second embodiment of a control circuit for controlling the voltage-controlled filter of FIG. 4.

Another option for feeding filter A with a signal voltage derived from pre-amplifier 2 in addition to the supply of the control voltage is shown in FIG. 7 which is also applicable to the circuit of FIG. 4. In FIG. 7, transistor T3 is connected to capacitor C8 via potentiometer $R'_e$, whereby transistor T4 is connected to the adjustable terminal of said potentiometer via resistor $R_e$.

Figure 5:
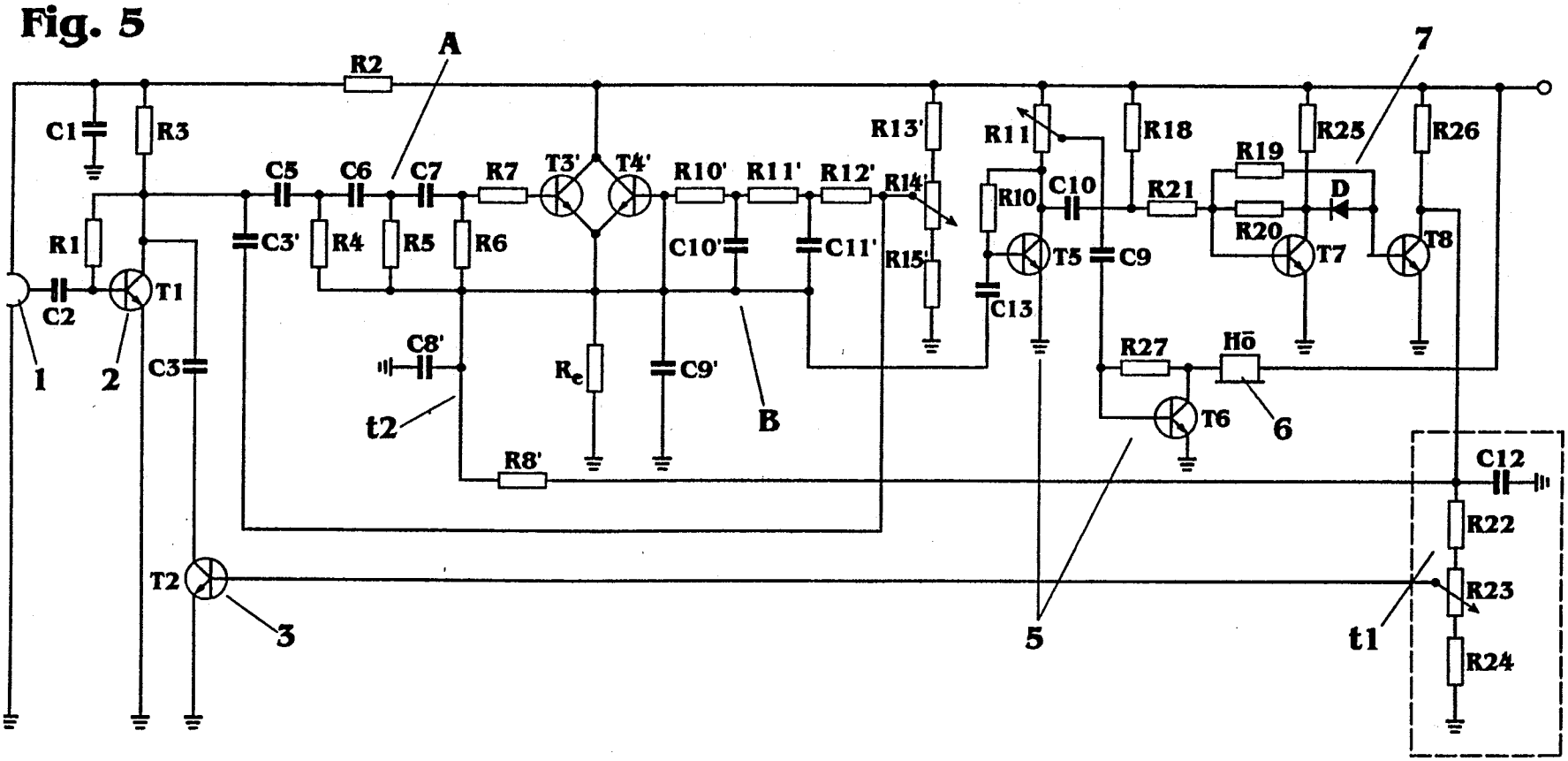
FIG. 5 is a circuit diagram of a second embodiment of the hearing aid of the invention.

FIG. 5 shows a second embodiment of the hearing aid of the invention. FIG. 5 comprises the voltage-controlled filter of FIG. 3. In FIG. 5, capacitors C5 to C7 in combination with resistors R4 to R6 provide a high-pass filter and resistors R10', R11' and R12' in combination with capacitors C9', C10' and C11' provide a low-pass filter. The filters are similar to the four-terminal networks A and B of FIG. 3.

The control voltage $V_{c1}$ of FIG. 3 is derived from rectifier circuit 7 which consists in FIG. 5 of two transistors T7 and T8, diode D, resistors R18 to R21 and resistors R25 and R26. The voltage is supplied to the four terminal network A via resistors R8' and R6. In the amplifier circuit 7 of FIG. 5, resistor 18 functions as a balance.

The control voltage $V_{c2}$ of FIG. 3 is derived from the supply voltage and supplied to four-terminal network B via dividers R13' to R15', thus enabling, by changing the operating point of transistor T4', a change in the threshold of transistor T3' and thus also that of high-pass filter A.

In the embodiment of FIG. 5, rectifier circuit 7 has NPN transistors. The remainder of the circuit of FIG. 5 is essentially the same as that of FIG. 4. The time function element t1 consisting of resistors R22 to R24 and capacitor C12 and to which the voltage-controlled attenuator 3 formed by transistor T2 is connected, comprises a smaller time constant than that of the time function element t2. Time function element t2 is connected to the four terminal network A, whereby element t2 consists of capacitor C8' and resistor R8'.

I claim:

1. A single channel circuit for a hearing aid for persons with an impaired hearing faculty comprising:

a microphone, a pre-amplifier coupled to said microphone, a voltage controlled amplifier/attenuator coupled to said pre-amplifier, a voltage controlled filter having an adjustable frequency response, and coupled to said voltage controlled amplifier/attenuator, an output amplifier coupled to said voltage controlled filter, and an earphone coupled to said output amplifier; and, a full wave rectifier circuit coupled to said voltage controlled filter for producing a first voltage signal for controlling said voltage controlled filter via a first time function element and producing a second voltage signal for controlling said voltage controlled amplifier/attenuator; wherein said full wave rectifier circuit including two parallel branches, a first transistor with a first emitter-collector path disposed in one of said branches, a second transistor with a second emitter-collector path disposed within the other of said branches, at least one resistor, said first and second emitter-collector paths being connected in series with said at least one resistor, a diode connecting the base of said second transistor to the collector of said first transistor; a second resistor connecting the base of said first transistor to the base of said second transistor, and a third resistor connecting the collector of said first transistor to the base of said first transistor, whereas said second voltage signal is coupled to the collector of said second transistor.

2. A single channel circuit for a hearing aid for an impaired hearing faculty comprising:

a microphone, a pre-amplifier coupled to said microphone, a voltage controlled amplifier/attenuator coupled to said pre-amplifier, a voltage controlled filter having an adjustable frequency response coupled to said voltage controlled amplifier/attenuator, an output amplifier coupled to said voltage controlled filter;

an earphone coupled to said output amplifier; and a rectifier circuit coupled to said voltage controlled filter for producing a first voltage signal for controlling said voltage controlled filter via a first time function element and a second voltage signal for controlling said voltage controlled amplifier/attenuator via a second time function element, said first and second time function elements having different time constants, said rectifier circuit including two parallel branches, a first transistor with a first emitter-collector path disposed in one of said branches, a second transistor with a second emitter-collector path disposed within the other of said branches, at least one resistor, said first and second emitter-collector paths being connected in series with said at least one resistor, a diode connecting the base of said second transistor to the collector of said first transistor, a second resistor connecting the base of said first transistor to the base of said second transistor, and a third resistor connecting the collector of said first transistor to the base of said first transistor, whereas said first voltage signal is coupled to the collector of said second transistor.

3. The single channel circuit according to claim 2, wherein said voltage controlled filter comprises a three pole network, and wherein the single channel circuit further includes a third transistor coupled to said three pole network in a boot strap circuit, and a fourth transistor whose emitter-collector path is connected in series to said third transistor, the base of said fourth transistor being connected to said rectifier circuit.

4. The single channel circuit according to claim 2, wherein said voltage controlled filter comprises a first three pole network, and a second three pole network, both having inputs and wherein, the single channel circuit further includes a third transistor, and a fourth transistor, said third transistor and said fourth transistor being coupled to said first and second three pole networks in a boot strap circuit, and at least one of the bases of said third and fourth transistors being connected to said rectifier circuit via said first time function element.

5. The single channel circuit according to claim 4, additionally including a potentiometer having a central terminal, whereas said pre-amplifier is coupled to the inputs of said first and second three pole network via said central terminal of said potentiometer.

6. The single channel circuit according to claim 2, wherein said voltage controlled filter comprises a four pole network, and wherein the single channel circuit further includes a third transistor coupled to said four pole network in a boot strap circuit, and a fourth transistor whose emitter-collector path is connected in series with said third transistor, the base of said fourth transistor being connected to said rectifier circuit.

7. The single channel circuit according to claim 6, additionally including a potentiometer circuit coupled to said pre-amplifier and said rectifier circuit for producing the first voltage signal for controlling said voltage controlled filter in the event of high signal levels.

8. The single channel circuit according to claim 2, wherein said voltage controlled filter comprises a first four pole network and a second four pole network both having inputs, and wherein the single channel circuit further includes a third transistor and a fourth transistor, said third and fourth transistor being coupled to said first and second four pole networks in a boot strap circuit, at least one of the bases of said third and fourth transistors being connected to said rectifier circuit via said first time function element.

9. The single channel circuit according to claim 8, additionally including a potentiometer having a central terminal, wherein said pre-amplifier is coupled to the inputs of said first and second four pole network via said central terminal of said potentiometer.

* * * * *